US006968769B2

(12) United States Patent
Kang

(10) Patent No.: US 6,968,769 B2
(45) Date of Patent: Nov. 29, 2005

(54) DIE ASSEMBLY

(75) Inventor: Pierson S. Kang, North Wales, PA (US)

(73) Assignee: Xynatech, Inc., Rio Rancho, NM (US)

( * ) Notice: Subject to any disclaimer, the term of this patent is extended or adjusted under 35 U.S.C. 154(b) by 0 days.

(21) Appl. No.: 10/241,054

(22) Filed: Sep. 10, 2002

(65) Prior Publication Data

US 2004/0045427 A1 Mar. 11, 2004

(51) Int. Cl.[7] ..... B26F 1/44
(52) U.S. Cl. ..... 83/862; 83/879; 493/468; 225/103
(58) Field of Search ..... 493/354, 468; 83/863, 879, 885, 862; 225/103

(56) References Cited

U.S. PATENT DOCUMENTS 2,949,151 A * 8/1960 Goldstein ..... 493/354 X
3,060,816 A * 10/1962 Martin ..... 493/354 X
3,142,233 A 7/1964 Downie
3,170,342 A 2/1965 Downie
3,244,335 A 4/1966 Downie
3,292,513 A * 12/1966 Palmer ..... 493/354
3,359,773 A * 12/1967 Stuchbery ..... 83/879 X
3,383,991 A * 5/1968 Sarka ..... 493/354
3,470,773 A * 10/1969 Mueller ..... 493/354 X
3,485,146 A * 12/1969 Sarka ..... 493/354
3,744,384 A * 7/1973 Jarritt et al. ..... 493/354 X
3,919,925 A * 11/1975 Hayama ..... 493/354 X
5,983,768 A * 11/1999 Abt et al. ..... 83/863 X
6,311,601 B1 * 11/2001 Love ..... 83/863

* cited by examiner

*Primary Examiner*—Charles Goodman
(74) *Attorney, Agent, or Firm*—Akin Gump Strauss Hauer & Feld, LLP

(57) ABSTRACT

A die assembly including a first die with a first die surface and a first cutting rib extending from the first die surface. The first cutting rib includes a first cutting surface parallel to the first die surface. The first cutting rib includes a leg extending from the first die surface to the first cutting surface at a first obtuse angle. A second die includes a second die surface and a second cutting rib extending from the second die surface. The second cutting rib includes a second cutting surface parallel to the second die surface. The second cutting surface is generally parallel to and defines a cutting overlap with the first cutting surface at a cross-section taken through the first and second dies in a cutting position. The cutting rib includes a leg extending from the second die surface to the second cutting surface at a second obtuse angle.

15 Claims, 4 Drawing Sheets

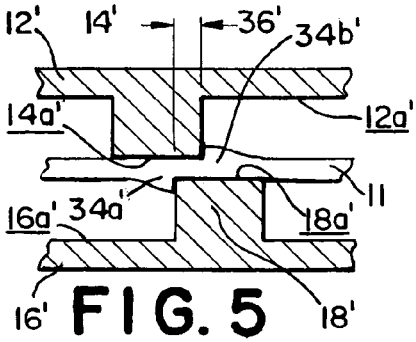
FIG. 5
PRIOR ART
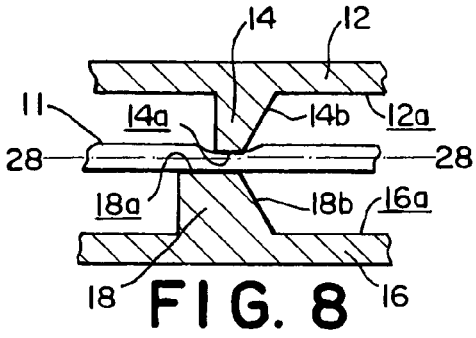
FIG. 8
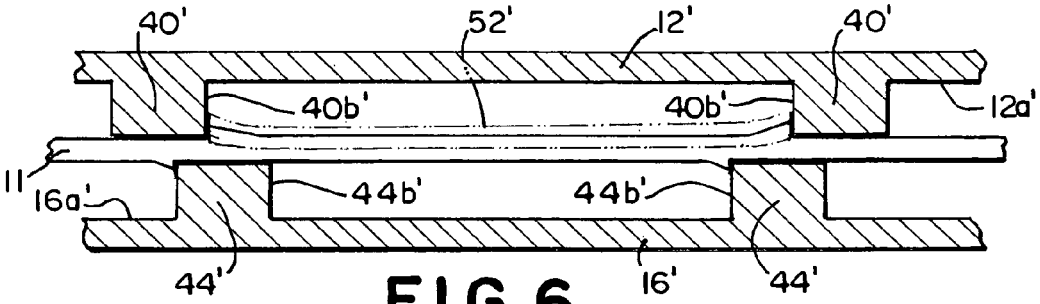
FIG. 6
PRIOR ART
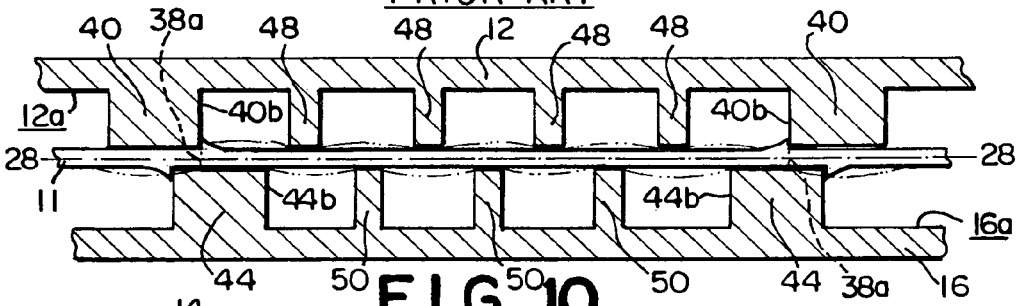
FIG. 10
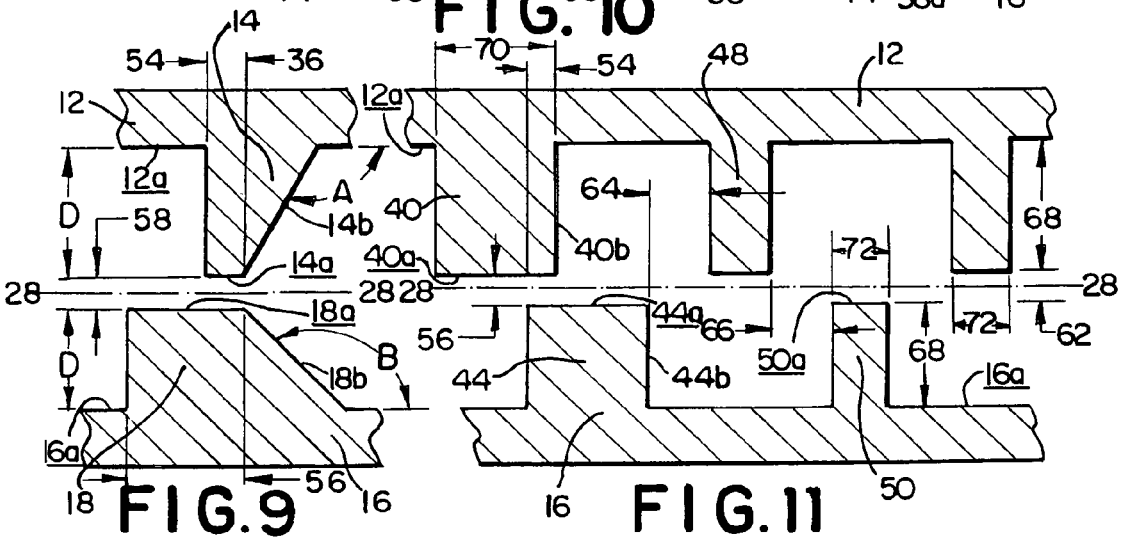
FIG. 9
FIG. 11

DIE ASSEMBLY

BACKGROUND OF THE INVENTION

The present invention is directed to a die assembly that cuts slits and holes in a sheet material.

The general concept of a die assembly that cuts a sheet material is well known in the art. Cutting die manufacturers have utilized a number of different configurations to cut a predetermined shape, for example, a container blank, from a sheet material. Generally, the predetermined shape is cut from the sheet material by exposing the sheet material to a first and second die that include a plurality of mating cutting and folding ribs protruding from surfaces of the dies. The dies may be positioned on rollers such that the sheet material is drawn through the rollers and cut at a tangent point or nip between the rollers. In addition, the sheet material may be positioned between two generally planar die plates that are brought together to cut the predetermined shape from the sheet material. U.S. Pat. Nos. 3,170,342 ("the '342 patent") and 3,142,233 disclose prior art die assemblies for cutting and scoring a predetermined shape from a sheet material.

The prior art die assemblies utilize either a sharpened cutter (see FIGS. 9 and 10 of the '342 patent) or a pair of blunt cutters (see FIG. 5) that overlap in a cutting position to cut the sheet material. The sharpened cutters quickly become dulled through normal use and require frequent maintenance by either sharpening the tip or replacing the cutter. Referring to FIG. 5, to remedy this maintenance and upkeep problem, blunt cutters or first and second prior art cutting ribs 14', 18' that overlap and cut the sheet material by compressing the sheet material between first and second blunt cutting surfaces 14*a*', 18*a*' of the cutters 14', 18' through pressure at an overlap 36' between the cutting surfaces 14*a*', 18*a*' were introduced. The blunt cutters 14', 18' do not become dulled and require less maintenance than the sharp cutters. However, referring to FIGS. 2 and 4, when the prior art blunt cutters 14', 18' are utilized to cut a slit 34' in a container blank 30' the edges 34*a*', 34*b*' including a downturned edge 34*a*' and a downturned edge 34*b*' of the slit 34' become misaligned. The slit 34' is a generally long, narrow cut or incision in the sheet material made internal to a peripheral cut 30*a*' of the container blank 30' where the edges 34*a*', 34*b*' of the sheet material remain on either side of the slit 34', for example, when cutting the slit 34' for adjacent container end flaps 30*b*' for a toothpaste box (see FIGS. 2–4). Cutting the slit 34' on the container blank 30' to create the end flaps 30*b*' with the prior art blunt cutters 14', 18' causes the edges 34*a*', 34*b*' of the box to become misaligned such that the downturned edge 34*a*' rests below the upturned edge 34*b*'. Consequently, when the container blanks 30' are arranged in a stack of container blanks 60', as is shown in FIG. 3, such that they may be prepared for further assembly on an assembly line there may be binding between the edges 34*a*', 34*b*'. On the assembly line, it is desired that a top container blank 30' slide in any direction relative to a lower container blank 30'. When the container blanks 30' with the misaligned edges 34*a*', 34*b*' are stacked for subsequent processing on the assembly line, the upturned edge 34*b*' of the lower container blank 30' interferes with the downturned edge 34*a*' of the top container blank 30'. Therefore, as can be seen in FIG. 4, if the top container blank 30' is urged in a first direction X', the downturned edge 34*a*' of the slit 34' engages an upturned edge 34' of the lower container blank 30' such that the lower container blank 30' binds with the upper container blank 30'. Accordingly, the upper container blank 30' is not able to slide relative to the lower container blank 30' for subsequent assembly. Depending upon which direction the particular manufacturer slides the individual container blanks 30' of the stack of container blanks 60', machinery may become jammed or the container blanks 30' may feed incorrectly.

Referring to FIGS. 2 and 6, blunt endless ribs 40', 44' of the prior art die cutting assemblies are also disadvantageous when a manufacturer wishes to cut a hole 38' in a sheet material. Referring to FIG. 6, cutting the hole 38' using the prior art blunt endless ribs 40', 44' oftentime causes a hole slug 52' of sheet material that is cut from the sheet material to become wedged between the endless ribs 40', 44' of prior art die plates 12', 16'. If a number of hole slugs 52' become wedged between the endless ribs 40', 44', the dies 12', 16' may become jammed because of a build up of hole slugs 52' and may be damaged or cut the sheet material improperly.

As manufacturers become increasingly aware of the limitations and disadvantages of the blunt cutters 14', 18', 40', 44' in performing specific types of cuts in sheet material, die assemblies that are able to overcome these limitations are increasingly important. Manufacturers who cut predetermined shapes from sheet material, for example box blanks, desire that the die assemblies produce container blanks that are able to be stacked and, once stacked, slide relative to one another in any direction to accommodate later assembly. In addition, the modern manufacturer desires that hole slugs that are removed from a container blank hole do not become wedged within the dies, thereby damaging the dies and/or damaging subsequent container blanks.

The dies cutting assembly of the present invention includes mating cutting ribs that extend from a first and second die surface with at least one leg that extends at an obtuse angle relative to the respective die surfaces. The angled leg of the cutting ribs urges the edges of the slits in the sheet material to remain aligned. These aligned slits permit the container blanks to be stacked one on top of the other such that edges of the slits are not upturned or downturned and do not bind with each other. Therefore, the container blanks slide relative to each other in a subsequent assembly line manufacturing process without binding, damaging the assembly line machinery or causing the assembly line to be shutdown. In addition, the die assembly includes mating endless ribs that extend from respective opposing die surfaces and lands that extend from the respective die surfaces within an enclosed area of the endless ribs. When cutting a hole in the sheet material utilizing the endless cuttings ribs and the lands, the hole slug within the periphery of the hole is retained on the sheet material subsequent to cutting and removing the container blank from the sheet material. Accordingly, as the sheet material is removed from the die, the hole slug remains attached to the container blank. Therefore, the hole slug does not become wedged between the endless cutting ribs and cause damage to either the dies or to subsequent container blanks that are cut using the die assembly.

BRIEF SUMMARY OF THE INVENTION

The present invention is directed to a die assembly for cutting a sheet material. The die assembly includes a first die with a first die surface and a first cutting rib extending from the first die surface. The first cutting rib includes a first cutting surface that is generally parallel to the first die surface. The first cutting rib also includes at lease one leg extending from the first die surface to the first cutting surface at a first obtuse angle relative to the first die surface. A second die includes a second die surface and a second cutting rib extending from the second die surface. The second cutting rib includes a second cutting surface that is generally parallel to the second die surface. The second cutting surface is generally parallel to and defines a cutting overlap with the first cutting surface at a cross-section taken through the first and second dies in a cutting position. The second cutting rib also includes at least one leg extending from the second die surface to the second cutting surface at a second obtuse angle relative to the second die surface.

In another aspect, the present invention is directed to a die assembly for cutting sheet material into a container blank including a hole within the container blank. The die assembly includes a first die with a first die surface and a first endless rib extending from the first die surface. The first endless rib defines a first closed area on the first die surface. At least one first land extends from the first die surface within the first closed area. The first land is separated from the first endless rib. A second die includes a second die surface and a second endless rib extending from the second die surface. The second endless rib defines a second closed area on the second die surface. At least one second land extends from the second die surface within the second closed area. The second land is separated from the second endless rib.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings:

FIG. 5 is a greatly enlarged partial cross sectional view of a mating pair of prior art cutting ribs, taken along a line similar to line 8—8 of FIG. 1;

FIG. 6 is a partial cross-sectional view of a mating pair of prior art endless ribs, used for cutting a hole in sheet material;

FIG. 8 is an enlarged partial cross-sectional view of a mating pair of cutting ribs of the die assembly of FIG. 1, taken along line 8—8 of FIG. 1;

FIG. 9 is a greatly enlarged cross-sectional view of the cutting ribs shown in FIG. 8;

FIG. 10 is a partial cross-sectional view of a mating pair of endless ribs and pins in accordance with the present invention; and FIG. 11 is a greatly enlarged fragmentary view of the endless ribs and lands shown in FIG. 10, without the sheet material therebetween.

DETAILED DESCRIPTION OF THE INVENTION

Figure 1:
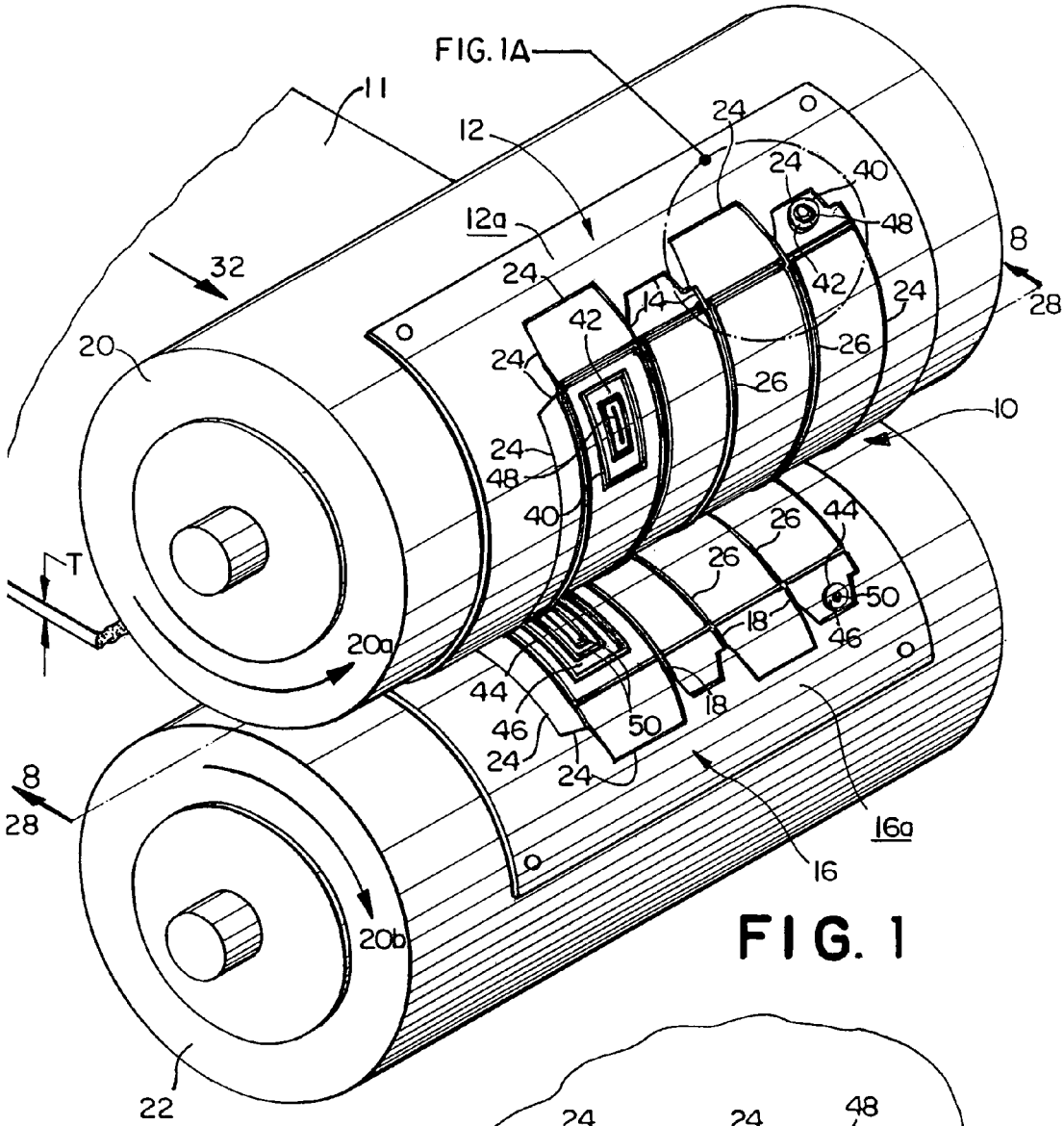
FIG. 1 is a front perspective view of a die cutting assembly secured to a pair of rollers, in accordance with a preferred embodiment of the present invention.

Referring to the drawings in detail, wherein like numerals indicate like elements throughout, there is shown in FIGS. 1–3 and 7–11, a first preferred embodiment of a die assembly, generally designated 10, for cutting a sheet material 11 and cutting a container blank 30 including a hole 38 within the container blank 30 from the sheet material 11.

Referring to FIGS. 1, 5 and 8, the die assembly 10 includes a first die 12 with a first die surface 12*a* and a first cutting rib 14 extending from the first die surface 12*a*. The die assembly 10 also includes a second die 16 with a second die surface 16*a* and a second cutting rib 18 extending from the second die surface 16*a*. In the preferred embodiment, the first and second dies 12, 16 are constructed of a thin metallic material generated from a chemical etching process, such that the dies 12, 16 are relatively flexible. Since the chemical etching of flexible die sheets is well known to those skilled in the relevant art, a detailed explanation of the mechanics of the chemical etching process is unnecessary. It is preferred that the first and second dies 12, 16 be flexible such that the first die 12 may be secured to the surface of a first roller 20 and the second die 16 may be secured to the surface of a second roller 22. The first and second dies 12, 16 are secured to the rollers 20, 22 such that a plurality of chopping ribs 24, a plurality of folding ribs 26 and the first and second cutting ribs 14, 18 aligned when they are located on a tangent line 28 between the rollers 20, 22 as the rollers 20, 22 rotate in first and second roll directions 20*a*, 20*b*. Alignment of the ribs 14, 18, 24 and 26 permits the die assembly 10 to cut the container blank 30 from the sheet material 11 as the sheet material 11 is fed through the rollers 20, 22 at the tangent line 28 in a sheet feed direction 32. The rollers 20, 22 are particularly suited to quickly manufacturing a large quantity of container blanks 30 in an assembly line method.

The first and second dies 12, 16 are not limited to constructions of thin metallic material formed from chemical etching and may be constructed of nearly any process and material that results in a relatively strong and stiff die and is able to take on the general shape of the first and second dies 12, 16. For example, the dies 12, 16 may be constructed of a rigid polymeric material that is injection molded into the general shape of the dies 12, 16. In addition, the die assembly 10 is not limited to manufacturing configurations including the above-described rollers 20, 22 to cut container blanks 30 from the sheet material 11. For example, the dies 12, 16 may be constructed by machining the ribs 14, 18, 24 and 26 onto a pair of surfaces of metallic blocks. The sheet material 11 may then be positioned between the machined surfaces to cut the container blanks 30 in the same manner that a conventional flat cutting die is utilized.

Referring to FIGS. 2–4 and 7–9, it is preferred that the first and second cutting ribs 14, 18 produce a slit 34 that is located within a peripheral cut 30*a* of the container blank 30. Preferably, the first and second cutting ribs 14, 18 are utilized to cut the slit 34 because the first and second cutting ribs 14 and 18 are configured such that edges 34*a*, 34*b* of the slit 34 are aligned following the cutting operation. In contrast, a prior art die assembly that utilizes squared first and second cutting ribs 14', 18' produces slits 34' that have downturned edges 34*a*' and upturned edges 34*b*'. The significance of the different slits 34, 34' was discussed in the Background of the Invention section and is discussed in greater detail below.

Referring to FIGS. 8 and 9, the first cutting rib 14 includes a first cutting surface 14*a* that is generally parallel to the first die surface 12*a* and at least one leg 14*b* extending from the first die surface 12*a* to the first cutting surface 14*a* at a first obtuse angle Δ relative to the first die surface 12*a*. In addition, the second cutting rib 18 includes a second cutting surface 18*a* that is generally parallel to the second die surface 16*a*. The second cutting rib 18 also includes at least one leg 18*b* that extends from the second die surface 16*a* to the second cutting surface 18*a* at a second obtuse angle β relative to the second die surface 16*a*.

In the preferred embodiment, the first and second cutting ribs 14, 18 extend to a depth D from the first and second die surfaces 12*a*, 16*a*. The depth D provides a relief space between the first and second die surfaces 12*a*, 16*a* and the sheet material 11 during a cutting operation such that the container blank 30 may be cut from the sheet material 11.

The second cutting surface 18*a* is generally parallel to and defines an overlap 36 with the first cutting surface 14*a* at a cross section taken through the first and second dies 12, 16 in a cutting position. In the preferred embodiment, the cross section is taken on a plane through a center of the rollers 20, 22, which passes through the tangent line 28. At the cross section, the first and second cutting surfaces 14*a*, 18*a* define the overlap 36, which permits the first and second cutting surfaces 14*a*, 18*a* to cut the sheet material 11 by imparting a pressure on the sheet material 11 between the cutting surfaces 14*a*, 18*a*, within the overlap 36. The cutting of the sheet material 11 within the overlap 36 is similar to the manner in which the prior art first and second cutting ribs 14', 18' cut the sheet material 11 in an overlap 36' between a first cutting surface 14*a*' and a second cutting surface 18*a*' (See FIG. 5).

Referring to FIGS. 4, 5 and 7-9, the cutting ribs 14, 18 of the present invention differ from the prior art cutting ribs 14', 18' in that the first and second cutting ribs 14, 18 include the legs 14*b*, 18*b* that extend from the first and second die surfaces 12*a*, 16*a* at the first and second obtuse angles Δ, β. In contrast, the prior art cutting ribs 14', 18' are generally squared at their junction with first and second die surfaces 12*a*', 16*a*'. The first and second obtuse angles Δ, permit the cutting ribs 14, 18 to urge the edges 34*a*, 34*b* of the slit 34 to remain aligned such that the misaligned edges 34*a*', 34*b*' of the prior art container blank 30' are not created.

Referring to FIGS. 4, 5, 8 and 9, in the preferred embodiment, the first and second die surfaces 12*a*, 16*a* and the first and second cutting surfaces 14*a*, 18*a* are generally parallel at the cross section taken through the first and second dies 12, 16 when the first and second dies 12, 16 are in the cutting position. The first cutting surface 14*a* and the second cutting surface 18*a* also preferably have a first width 54 and a second width 56, respectively. In the preferred embodiment, the cutting overlap 36 is less than the second width 56. Specifically, in the configuration of the die assembly 10 shown in FIG. 9, the first width 54 is approximately equivalent to the overlap 36, each of which is less than the second width 56. Such a configuration of the first and second cutting surfaces 14*a*, 18*a* along with the angled legs 14*b*, 18*b* permit the cutting ribs 14, 18 to cut the slit 34 in the container blank 30 with aligned edges 34*a*, 34*b*. Specifically, the angled legs 14*b*, 18*b* and portion of the second cutting surface 18*a* that is located outside of the overlap 36, urge each of the edges 34*a*, 34*b* to remain centered along the tangent line 28 during the cutting operation as well as remaining aligned following the cutting operation. Therefore, the distortion or misalignment of the edges 34*a*', 34*b*' produced by the prior art cutting ribs 14', 18', is avoided. The overlap 36 is not limited to dimensions that are smaller than the second width 54. For example, the overlap 36 may be the same size as the first and second widths 54, 56.

It is also preferred that the first and second obtuse angles Δ, β are between ninety-five and one hundred sixty degrees. Specifically, in the configuration shown in FIG. 9, the first obtuse angle Δ is approximately one hundred twenty degrees and the second obtuse angle is approximately one hundred thirty-five degrees. The first and second obtuse angles Δ, are designed based on a number of factors, one of which is a thickness T of the sheet material 11 and another of which is the type of sheet material 11 that is being cut. As a general rule, as the thickness T of the sheet material 11 increases, at least one of the first and second obtuse angles Δ, decreases to produce the slit 34 with aligned edges 34*a*, 34*b*.

In the cutting position, a gap 58 is preferably formed between the first and second cutting surfaces 14*a*, 18*a*. Generally the size of the gap 58, overlap 36 and first and second obtuse angles Δ, are critical in producing the desired aligned slits 34 of the die assembly 10. Specifically, in the preferred embodiment, the gap 58 is generally between zero to fifty percent of the sheet material thickness T, the overlap 36 is between five and forty percent of the sheet material thickness T and the angles Δ, are between ninety-five and one hundred sixty degrees, as was discussed above. For example, testing has shown that an aligned slit 34 is produced using the die assembly 10 to cut a paperboard material 11 having a sheet material thickness T of approximately eight to fifteen thousandths of an inch using a gap 58 of approximately one thousandth of an inch, an overlap 36 of approximately two thousands of an inch, a first obtuse angle of approximately one hundred twenty degrees and a second obtuse angle of approximately one hundred thirty-five degrees. In addition, testing has also shown that an aligned slit 34 is produced using the die assembly 10 to cut the paperboard material 11 having a sheet material thickness T of approximately twenty-three to thirty-six thousandths of an inch using a gap 58 of approximately six to eight thousandth of an inch, an overlap 36 of approximately seven thousands of an inch, a first obtuse angle Δ of approximately one hundred twenty degrees and a second obtuse angle of approximately one hundred five degrees.

Figures 2, 3:
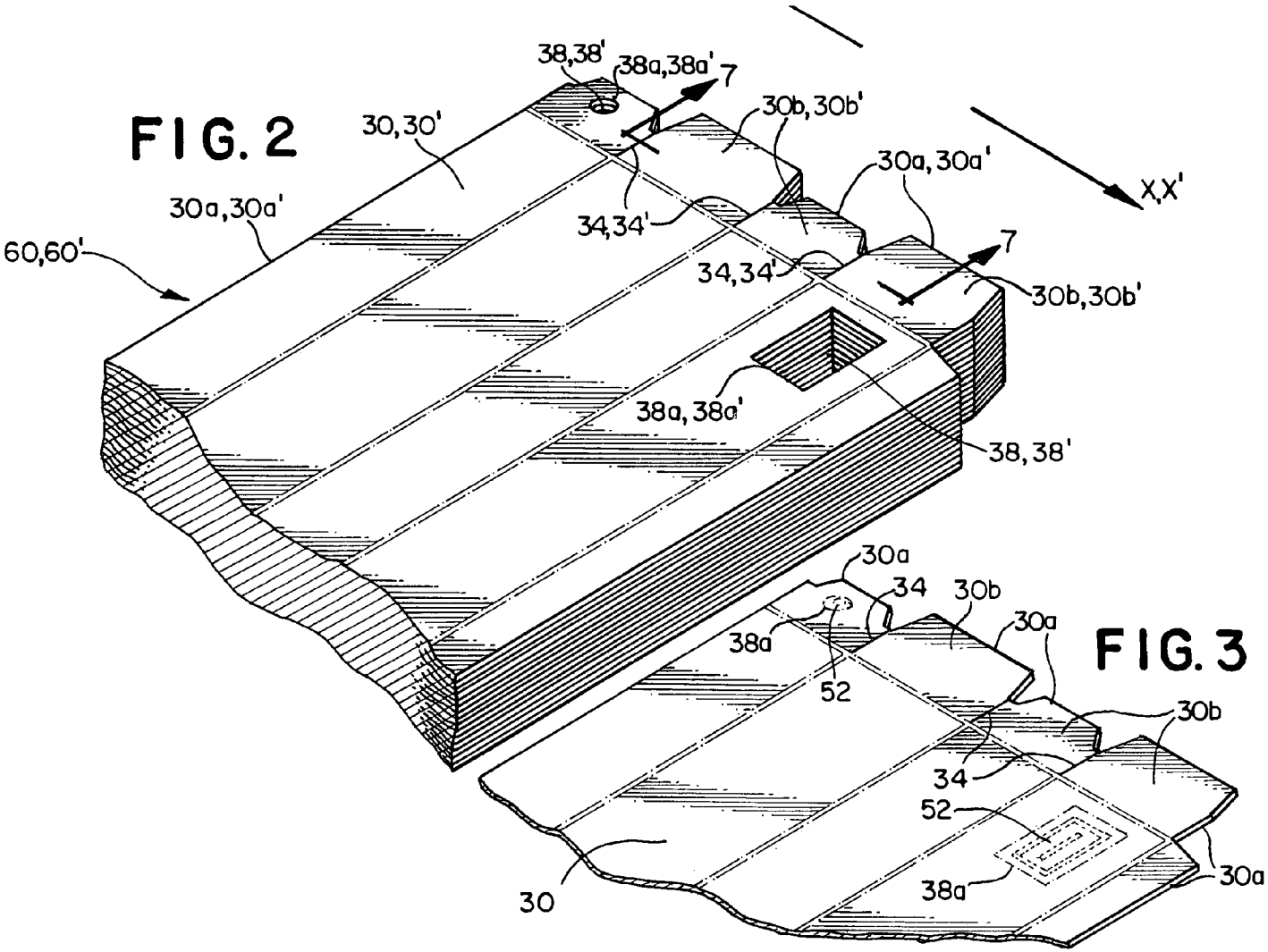
FIG. 2 is a partial top perspective view of a stack of container blanks.
FIG. 3 is a partial top perspective view of a single container blank.

Referring to FIGS. 1, 2, 4 and 7, as was partially discussed above, the first and second cutting ribs 14, 18 are designed to cut the slits 34 in the sheet material 11 such that the edges 34*a*, 34*b* of the slit 34 are aligned. For example, the slits 34 are utilized in producing container blanks 30 and specifically for producing end flaps 30*b* of the container blanks 30 for toothpaste, cereal, candy and/or other boxes. In operation, the sheet material 11 is preferably fed into the rollers 20, 22 adjacent the tangent line 28 in the sheet feed direction 32. At the tangent line 28, the sheet material 11 is introduced to the first and second dies 12, 16, which makes various cuts and folds in the sheet material 11, including the slits 34 to produce the container blank 30. The dies 12, 16 and rollers 20, 22 also draw the sheet material 11 through the cutting position by rotating in the first and second roll directions 20*a*, 22*a*. As the sheet 11 is drawn through the rollers 20, 22 and the peripheral cut 30*a* is completed, the container blank 30 separates from the sheet material 11 and is generally displaced on a conveyor (not shown) for further processing. The container blank 30 is then generally stacked in a stack of container blanks 60, 60', as is shown in FIG. 2.

Figure 4:
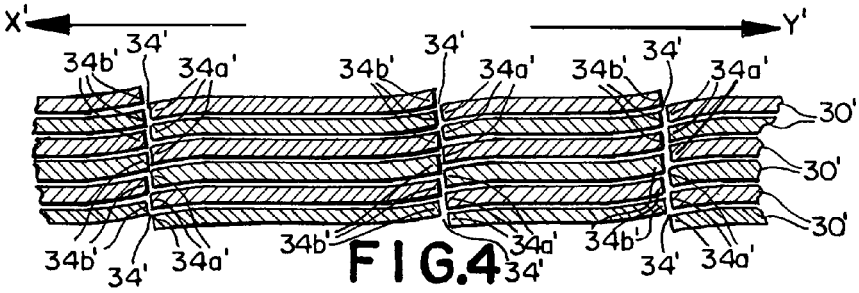
FIG.4 PRIOR ART
FIG. 4 is a cross-sectional view of a stack of prior art container blanks produced using a prior art die assembly, taken along a line similar to line 7—7 of FIG. 2.

Referring to FIGS. 2 and 4, from the stack of container blanks 60, 60', a manufacturer generally attempts to slide a single container blank 30 from the top of the stack of container blanks 60, 60' in either one of a first or second sliding direction X, X', Y, Y'. As is shown in FIG. 4, when the top prior art container blank 30' is slid in the first sliding direction X' the downturned edges 34*a*' of the top container blank 30' impinge upon the upturned edges 34*b*' of the container blank 30' immediately below the top container blank 30'. Accordingly, the top container blank 30' either drags the container blank 30' immediately below in the first sliding direction X', further distorts the edged 34*a*', 34*b*' to attempt to break free from the lower container blank 30' and/or becomes stuck and binds the manufacturing assembly line. In addition, when the top container blank 30' is slid in the second sliding direction Y' the upturned edges 34*b*' generally provide sliding clearance permitting the top container blank 30' to roughly slide over the upturned edges 34*b*' of the container blank 30' immediately below the top container blank 30' in the stack of container blanks 60'. However, the downturned edges 34*a*' may become caught on the lower upturned edges 34*b*' as the top container blank 30' is slid from the stack of container blanks 60' in the second sliding direction Y', thereby causing similar problems to sliding the top container blank 30' in the first sliding direction X'. Therefore, attempting to slide the top container blank 30' in either direction produces, at best, inconsistent results for manufacturers and at worst, stops the assembly line as the bound stack of container blanks 60' are removed from the assembly line.

Figure 7:
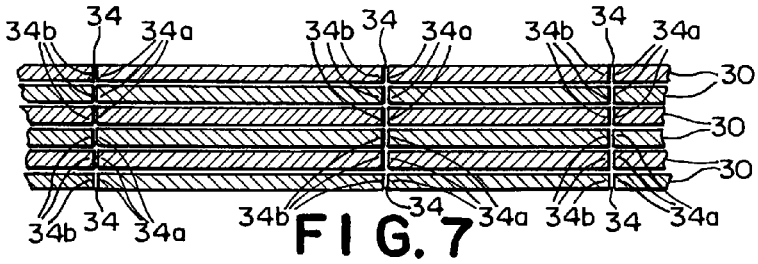
FIG. 7 is a greatly enlarged cross-sectional view of a stack of container blanks produced using the die assembly of FIG. 1; taken along line 7—7 of FIG. 2.

Referring to FIGS. 2 and 7, by utilizing the die assembly 10 with the cutting ribs 14, 18, container blanks 30 with aligned edges 34*a*, 34*b* at the slits 34 are produced. Accordingly, when the manufacturer slides the top container blank 30 of the stack of container blanks 60 in either of the first sliding direction X or the second sliding direction Y, the edges 34*a*, 34*b* do not impinge upon each other. Therefore, when the stack of container blanks 60 is positioned in the assembly line, the sliding operation functions smoothly and the assembly line operates continuously without binding of the stack of container blanks 60.

Referring to FIGS. 2, 3, 6, 10 and 11, the die assembly 10 is also configured to cut a hole 38 within the peripheral cut 30*a* of the container blank 30. The first die 12 includes a first endless rib 40 extending from the first die surface 12*a* and the second die 16 includes a second endless rib 44 extending from the second die surface 16*a* for cutting a peripheral edge 38*a* of the hole 38. The first endless rib 40 defines a first closed area 42 on the first die surface 12*a* and the second endless rib 44 defines a second closed area 46 on the second die surface 16*a*. At least one first land 48 extends from the first die surface 12*a* within the first closed area 42 and at least one second land 50 extends from the second die surface 16*a* within the second closed area 46. The first and second lands 48, 50 are separated from the first and second endless ribs 40, 44.

The above-described configuration of the endless ribs 40, 44 and lands 48, 50 permits the die assembly 10 to create a hole slug 52 that remains attached to the container blank 30 after the container blank 30 is removed from the die assembly 10. That is, after the hole 38 is cut in the container blank 30, the hole slug 52 remains attached to the container blank 30 as opposed to being released from the container blank 30 immediately after cutting. In contrast, the prior art die assembly includes endless ribs 40', 44' that do not include lands disposed therebetween. Accordingly, when a hole 38' is cut using the prior art endless ribs 40', 44', a hole slug 52' is created that may become wedged between the endless ribs 40', 44'. As was discussed above, if the hole slug 52' becomes wedged in the prior art die assembly, the die assembly may become damaged and/or the prior art container blank 30' may be cut imprecisely.

Referring to FIGS. 1, 10 and 11, in the preferred embodiment, the first endless rib 40 includes a first scoring surface 40*a* and the second endless rib 44 includes a second scoring surface 44*a*. The first and second scoring surfaces 40*a*, 44*a* define a scoring overlap 54 and a scoring gap 56 in the cutting position to score the peripheral edge 38*a* of the hole 38 in the sheet material 11. The scoring overlap and gap 54, 56 of the first and second scoring surfaces 40*a*, 44*a* permit creation of the peripheral edge 38*a* of the hole 38 and the hole slug 52. In the preferred embodiment, the scoring overlap 54 is generally between five and forty percent of the sheet material thickness T and the scoring gap 56 is generally between five and forty-five percent of the sheet material thickness T, depending upon the type of sheet material 11 that is utilized. The scoring overlap and gap 54, 56 are not limited to the above-listed dimensions and may take on nearly any dimension that permits the endless ribs 40, 44 to cut the hole slug 52 from the sheet material 11 without allowing the hole slug 52 to release from the sheet material 11 or container blank 30 following cutting.

Preferably, the first and second lands 48, 50 include first and second retaining surfaces 48*a*, 50*a*, respectively. The first and second retaining surfaces 48*a*, 50*a* define a retaining gap 62 therebetween, the second endless rib 44 and the first retaining land 48 defining a first offset 64 therebetween and the first land 48 and second land 50 define a second offset 66 therebetween in the cutting position to prevent the hole slug 52 from being wedged between lateral edges 40*b*, 44*b* of at least one of the first and second endless ribs 40, 44. In the preferred embodiment, the first and second offsets 64, 66 are approximately equal to the sheet material thickness T and the retaining gap 62 is approximately equal to the gap 58, depending upon the type of sheet material 11 that is being utilized. For example, when the paperboard material 11 is utilized, testing has shown that first and second offsets 64, 66 approximately equal to the paperboard thickness T plus between ten and twenty thousandths of an inch will permit the hole slug 52 to be retained with the paperboard material 11 or the container blank 60 after the peripheral edge 38*a* of the hole 38 is cut. The retaining gap 62 and first and second offsets 64, 66 are not limited to the above-described dimensions and may take on any number of dimensions depending on the type of sheet material 11 being utilized, the thickness T of the sheet material 11 and/or a number of other factors.

Figure 1A:
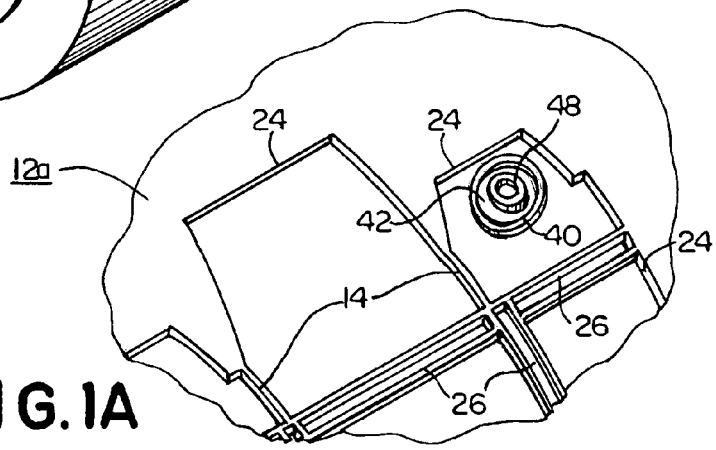
FIG. 1*a* is a greatly enlarged fragmentary view of a portion of a first die of the die assembly shown in FIG. 1.

Referring to FIGS. 1, 1A and 2 in the preferred embodiment, a pair of holes 38 are cut in the sheet material 11 including a circular hole 38 and a rectangular hole 38. The first and second endless ribs 40, 44 utilized to cut the peripheral edge 38*a* of the circular and rectangular holes 38 have a generally circular and rectangular shape and define generally circular and rectangular first and second closed areas 42, 46 on the first and second die surfaces 12*a*, 16*a*, respectively. The first and second lands 48, 50 of the preferred embodiment have generally circular and rectangular shapes that decrease in size as they are positioned closer to a center of the first and second closed areas 42, 44. In addition, the first lands 48 include a linear land 48 that traverses an approximate center of the first closed area 42. The first and second endless ribs 40, 44 and first and second lands 48, 50 are not limited to the above-described configuration and may take on nearly any shape to create nearly any shaped hole 38 within the sheet material 11. The key being that the combination of the first and second endless ribs 40, 44 and the first and second lands 48, 50 cut the peripheral edge 38*a* of the hole 38 such that the hole slug 52 is retained on the container blank 30 when the container blank 30 is removed from the sheet material 11.

Referring to FIG. 11, the first and second endless ribs 40, 44 and first and second lands 48, 50 preferably extend from the first and second die surfaces 12*a*, 16*a* to a depth 68. That is, the first and second endless ribs and lands 40, 44, 48, 50 extend from the first and second die surfaces 12*a*, 16*a* to the first and second scoring and retaining surfaces 40*a*, 44*a*, 48*a*, 50*a* to the depth 68. The endless ribs and lands 40, 44, 48, 50 are not limited to extending from the first and second die surfaces 12*a*, 16*a* to the depth 68 but may extend from the first and second die surfaces 12*a*, 16*a* to a number of different depths. For example, the endless ribs 40, 44 may extend to a first depth and the lands 48, 50 may extend to a second shorter depth, which produces a hole slug 52 that is retained on the container blank 30 after the peripheral cut 30*a* is completed. However, manufacturing of the die assembly 10 including endless ribs and lands 40, 44, 40, 50 that extend to the depth 68 is preferred to simplify construction of the first and second dies 12, 16.

Referring to FIGS. 10 and 11, in the preferred embodiment, the first and second scoring surfaces 40*a*, 44*a* have a scoring width 70 and the first and second retaining surfaces 48*a*, 50*a* have a retaining width 72. The scoring width 70 is preferably greater than the retaining width 72. The retaining and scoring widths 70, 72 are not limited to the above-described configuration and may take on nearly and dimension that permits the endless ribs 40, 44 and lands 48, 50 to cut the peripheral edge 38*a* of the hole 38 such that the hole slug 52 is retained with the sheet material 11 and/or container blank 30 following cutting of the peripheral edge 38*a* and cutting of the peripheral cut 30*a*.

Those skilled in the art will appreciate that changes could be made to the embodiment described above without departing from the broad inventive concept thereof. It is understood, therefore, that this invention is not limited to the particular embodiments disclosed, but is intended to cover modifications within the spirit and scope of the present invention, as defined by the appended claims.

I claim:

1. A die assembly for cutting a sheet material comprising:

a first die including a first die surface and a first cutting rib extending from the first die surface, the first cutting rib including a first cutting surface that is generally parallel to the first die surface, the first cutting rib including at least one leg extending from the first die surface to the first cutting surface at a first obtuse angle relative to the first die surface; and a second die including a second die surface and a second cutting rib extending from the second die surface, the second cutting rib including a second cutting surface that is generally parallel to the second die surface, the second cutting surface being generally parallel to and defining a cutting overlap with the first cutting surface at a cross section taken through the first and second dies in a cutting position, the second cutting rib including at least one leg extending from the second die surface to the second cutting surface at a second obtuse angle relative to the second die surface.

2. The die assembly of claim 1 wherein the first and second die surfaces and the first and second cutting surfaces are generally parallel at the cross section taken through the first and second dies when the first and second dies are in the cutting position.

3. The die assembly of claim 2 wherein the first cutting surface has a first width and the second cutting surface has a second width, the cutting overlap being less than the second width.

4. The die assembly of claim 1 wherein the first and second obtuse angles are between ninety-five and one hundred sixty degrees.

5. The die assembly of claim 4 wherein the first obtuse angle is approximately one hundred twenty degrees and the second obtuse angle is approximately one hundred thirty-five degrees.

6. The die assembly of claim 1 wherein the first and second cutting ribs extend to a depth from the first and second die surfaces.

7. The die assembly of claim 1 wherein the first and second dies are constructed of a thin metallic material.

8. The die assembly of claim 1 wherein the first and second cutting ribs produce a slit in the sheet material that is located within a peripheral cut of a container blank cut from the sheet material utilizing the die assembly.

9. The die assembly of claim 1 wherein a gap is formed between the first and second cutting surfaces in the cutting position.

10. A die assembly for cutting a sheet material into a container blank including a hole within the container blank and recites, as follows:

a first die including a first die surface, a first peripheral chopping rib and a first endless rib extending from the first die surface, the first endless rib defining a first closed area on the first die surface;

at least one first land extending from the first die surface within the first closed area, the first land being separated from the first endless rib;

a second die including a second die surface, a second peripheral chopping rib and a second endless rib extending from the second die surface, the second endless rib defining a second closed area on the second die surface, the first and second peripheral chopping ribs making a peripheral cut of the container blank; and at least one second land extending from the second die surface within the second closed area, the second land being separated from the second endless rib.

11. The die assembly of claim 10 further comprising:

a first scoring surface formed on the first endless rib; and a second scoring surface formed on the second endless rib, the first and second scoring surfaces defining a scoring overlap and a scoring gap in a cutting position to score a peripheral edge of the hole in the sheet material, thereby creating a hole slug of sheet material bounded by the peripheral edge of the hole.

12. The die assembly of claim 11 further comprising:

a first retaining surface formed on the first land; and a second retaining surface formed on the second land, in the cutting position, the first and second retaining surfaces defining a retaining gap therebetween, the second endless rib and first land defining a first offset therebetween and first land and second land defining a second offset therebetween to prevent the hole slug from being wedged between lateral edges of at least one of the first and second endless ribs.

13. The die assembly of claim 12 wherein the offset is approximately equal to a thickness of the sheet material.

14. The die assembly of claim 10 wherein the first and second endless ribs and lands extend from the first and second die surfaces to a depth.

15. The die assembly of claim 11 wherein the first and second scoring surfaces have a scoring width and the first and second lands include a retaining surface having a retaining width, the scoring width being greater than the retaining width.

* * * * *